US011236928B2

(12) United States Patent
Tamboli et al.

(10) Patent No.: US 11,236,928 B2
(45) Date of Patent: Feb. 1, 2022

(54) CURB ASSEMBLY FOR HVAC SYSTEM

(71) Applicant: Johnson Controls Technology Company, Auburn Hills, MI (US)

(72) Inventors: Manjur Tamboli, Norman, OK (US); Neelkanth S. Gupte, Katy, TX (US); Sarjerao D. Pingale, Pune (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 123 days.

(21) Appl. No.: 16/441,535

(22) Filed: Jun. 14, 2019

(65) Prior Publication Data

US 2020/0370782 A1 Nov. 26, 2020

Related U.S. Application Data

(60) Provisional application No. 62/850,383, filed on May 20, 2019.

(51) Int. Cl.

| | |
|---|---|
| ***F24F 13/20*** | (2006.01) |
| ***F24F 13/02*** | (2006.01) |
| ***F24F 13/32*** | (2006.01) |

(52) U.S. Cl.

CPC ..... *F24F 13/20* (2013.01); *F24F 13/0209* (2013.01); *F24F 13/32* (2013.01); *F24F 2221/16* (2013.01)

(58) Field of Classification Search

CPC ..... F24F 13/20; F24F 13/0209; F24F 13/32; F24F 2221/16

USPC ..... 62/259.1

See application file for complete search history.

(56) References Cited

U.S. PATENT DOCUMENTS

| | | | | |
|---|---|---|---|---|
| 4,917,345 | A * | 4/1990 | Czech | F16M 7/00 248/237 |
| 6,044,592 | A | 4/2000 | Strieter | |
| 6,343,439 | B1 | 2/2002 | Rutledge | |
| 8,528,875 | B2 * | 9/2013 | Wilson, Jr. | F24F 13/32 248/561 |
| 8,701,355 | B2 | 4/2014 | Sexton | |
| 8,960,620 | B1 * | 2/2015 | Merideth | F24F 13/32 248/237 |
| 10,082,315 | B2 | 9/2018 | Marks | |
| 2010/0269943 | A1 * | 10/2010 | Arai | F24F 13/0209 138/119 |
| 2012/0210654 | A1 * | 8/2012 | Sexton | E04D 13/1475 52/58 |
| 2014/0196495 | A1 * | 7/2014 | Marks | F24F 13/32 62/426 |
| 2017/0284683 | A1 * | 10/2017 | Gallo | F24F 13/0245 |
| 2018/0100611 | A1 * | 4/2018 | Fanelli | F16L 25/14 |

* cited by examiner

*Primary Examiner* — Steve S Tanenbaum

(74) *Attorney, Agent, or Firm* — Fletcher Yoder, P.C.

(57) ABSTRACT

A curb assembly for a heating, ventilation, and/or air conditioning (HVAC) system includes a frame configured to couple to a curb of a structure, a pedestal system configured to couple to a housing of the HVAC system and to the frame, such that the pedestal system extends from the housing to the frame, and an adjustable duct connector configured to fluidly couple an air flow passage of the housing with ductwork of the structure. The pedestal system is configured to enclose a space formed between the frame and the housing and the adjustable duct connector configured to be disposed within the space.

8 Claims, 14 Drawing Sheets

CURB ASSEMBLY FOR HVAC SYSTEM

CROSS REFERENCE TO RELATED APPLICATIONS

This application claims priority from and the benefit of U.S. Provisional Application Ser. No. 62/850,383, entitled "CURB ASSEMBLY FOR HVAC SYSTEM", filed May 20, 2019, which is hereby incorporated by reference in its entirety for all purposes.

BACKGROUND

This section is intended to introduce the reader to various aspects of art that may be related to various aspects of the present disclosure, and are described below. This discussion is believed to be helpful in providing the reader with background information to facilitate a better understanding of the various aspects of the present disclosure. Accordingly, it should be understood that these statements are to be read in this light, and not as admissions of prior art.

HVAC systems are utilized in residential, commercial, and industrial environments to control environmental properties, such as temperature and humidity, for occupants of the respective environments. An HVAC system may control the environmental properties through control of an air flow delivered to the environment. For example, the HVAC system may place the air flow in a heat exchange relationship with a refrigerant to condition the air flow. In some cases, a portion of the HVAC system may be coupled to a curb of a structure to enable the HVAC system to utilize ambient air as a portion of the air flow, to exhaust return air into an ambient environment, and/or to supply conditioned air to a conditioned space within the structure. Existing HVAC systems may include a variety of sizes and shapes, such that coupling the HVAC system to the curb may be expensive and/or time consuming.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a curb assembly for a heating, ventilation, and/or air conditioning (HVAC) system includes a frame configured to couple to a curb of a structure, a pedestal system configured to couple to a housing of the HVAC system and to the frame, such that the pedestal system extends from the housing to the frame, and an adjustable duct connector configured to fluidly couple an air flow passage of the housing with ductwork of the structure. The pedestal system is configured to enclose a space formed between the frame and the housing and the adjustable duct connector configured to be disposed within the space.

In another embodiment, a curb assembly kit for a housing of a heating, ventilation, and/or air conditioning (HVAC) system includes a frame configured to couple to a curb of a structure to be conditioned by the HVAC system, a support beam configured to couple to the housing and to engage the frame such that a space is formed between the housing and the frame, in which the support beam is configured to support a weight of the housing. The HVAC system further includes a duct connector configured to be disposed in the space, and is configured to fluidly couple an air flow passage of the curb with an air flow passage of the housing.

In another embodiment, a heating, ventilation, and/or air conditioning (HVAC) system includes a housing having a mounting frame for a housing of the HVAC system and configured to extend adjacent an external perimeter of the housing, a hinge a hinge configured to couple to the housing and having a first plate, a second plate, and a pivot, in which the first plate is coupled to the mounting frame, and the second plate is configured to rotate about the pivot relative to the mounting frame and the first plate. The HVAC system further includes a support beam coupled to the second plate, such that the support beam is configured to rotate about the pivot, wherein the support beam is configured to engage with a curb of a building.

DRAWINGS

Various aspects of this disclosure may be better understood upon reading the following detailed description and upon reference to the drawings in which.

DETAILED DESCRIPTION

Figure 1:
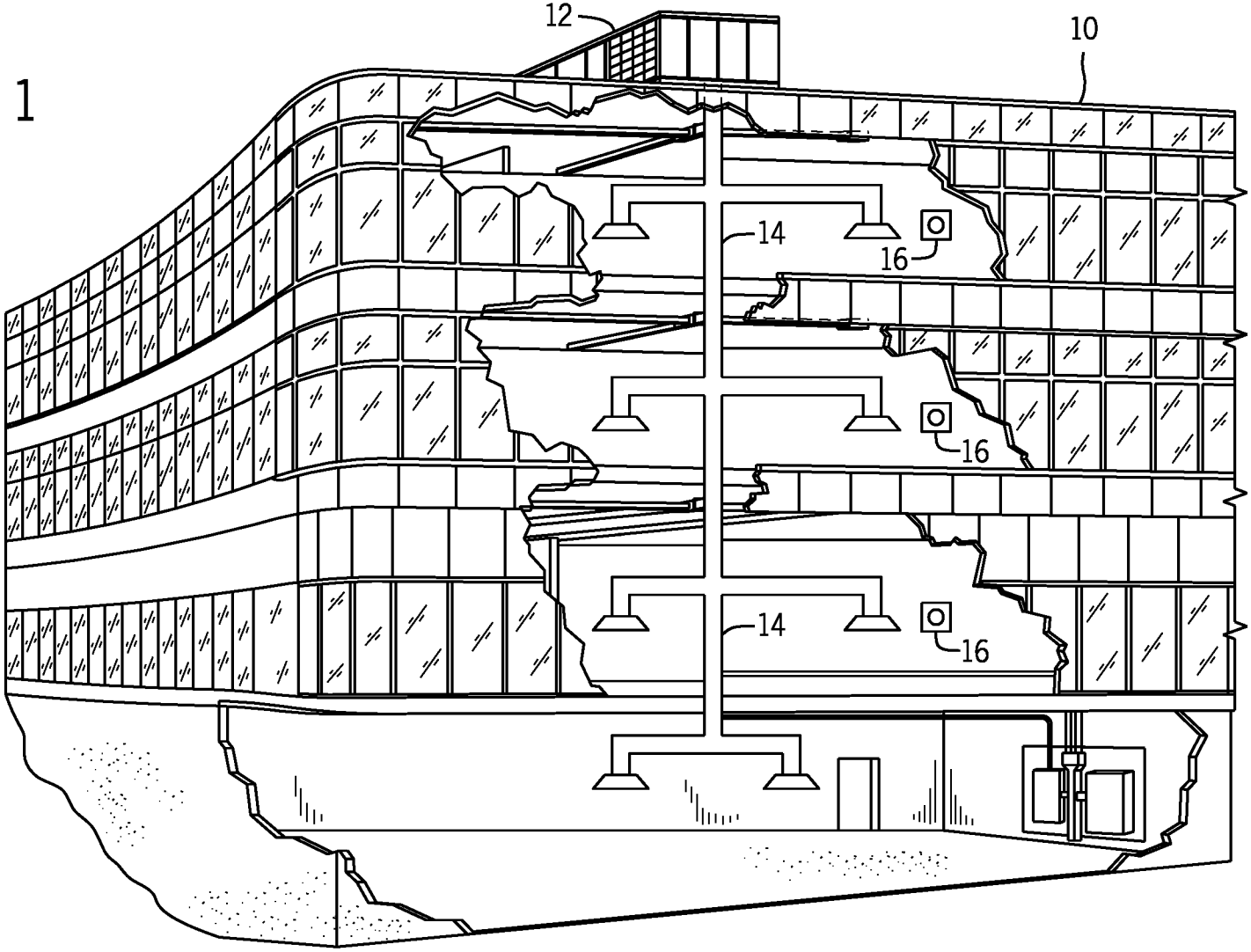
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system configured to couple to a curb of a structure or building to enable components of the HVAC system to be placed in fluid communication with ductwork of the structure that delivers conditioned air to various locations within the structure. For example, the HVAC system may be coupled to openings of the ductwork, such that the HVAC system may direct conditioned air toward or into the structure and/or receive return air from the structure. That is, a conditioned air flow may be directed through a first opening of the curb to supply conditioned air to the structure. Additionally, a return air flow may be directed from the structure through a second opening of the curb and back toward or into to the HVAC system. In some cases, the return air flow may be recycled by the HVAC system and redirected from the HVAC system into the structure as the conditioned air flow. In other embodiments, the return air flow, or a portion of the return air flow, may be exhausted to an ambient environment surrounding the HVAC system.

Different structures may include curbs having varying dimensions, configurations, and/or orientations. In some cases, a curb adapter may be used to couple a particular HVAC system to a particular curb. The curb adapter may conform with the dimensions of the curb and with the dimensions of the HVAC system to enable fluidly coupling of the HVAC system to the structure. However, curb adapters may substantially increase the cost of installing an HVAC system. For instance, existing curb adapters may be manufactured to accommodate a specific HVAC system and a specific curb and may increase costs associated with manufacturing and/or installing an HVAC system.

Accordingly, embodiments of the present disclosure are directed to a curb assembly that may be configured to couple a particular HVAC system with different sizes and/or shapes of curbs to facilitate supply of conditioned air to a structure serviced by the HVAC system. In other words, presently disclosed embodiments include a curb assembly that may be adjustable to facilitate coupling an HVAC system to curbs having varying dimensions, varying opening sizes and/or positions, and so forth. Accordingly, the curb assembly may not be limited to coupling to a particular HVAC system to a particular curb because the curb assembly may be adjustable to couple one of a plurality of different HVAC systems to one of a plurality of different curbs. As such, embodiments of the curb assembly disclosed herein may reduce manufacturing costs and/or installation costs of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
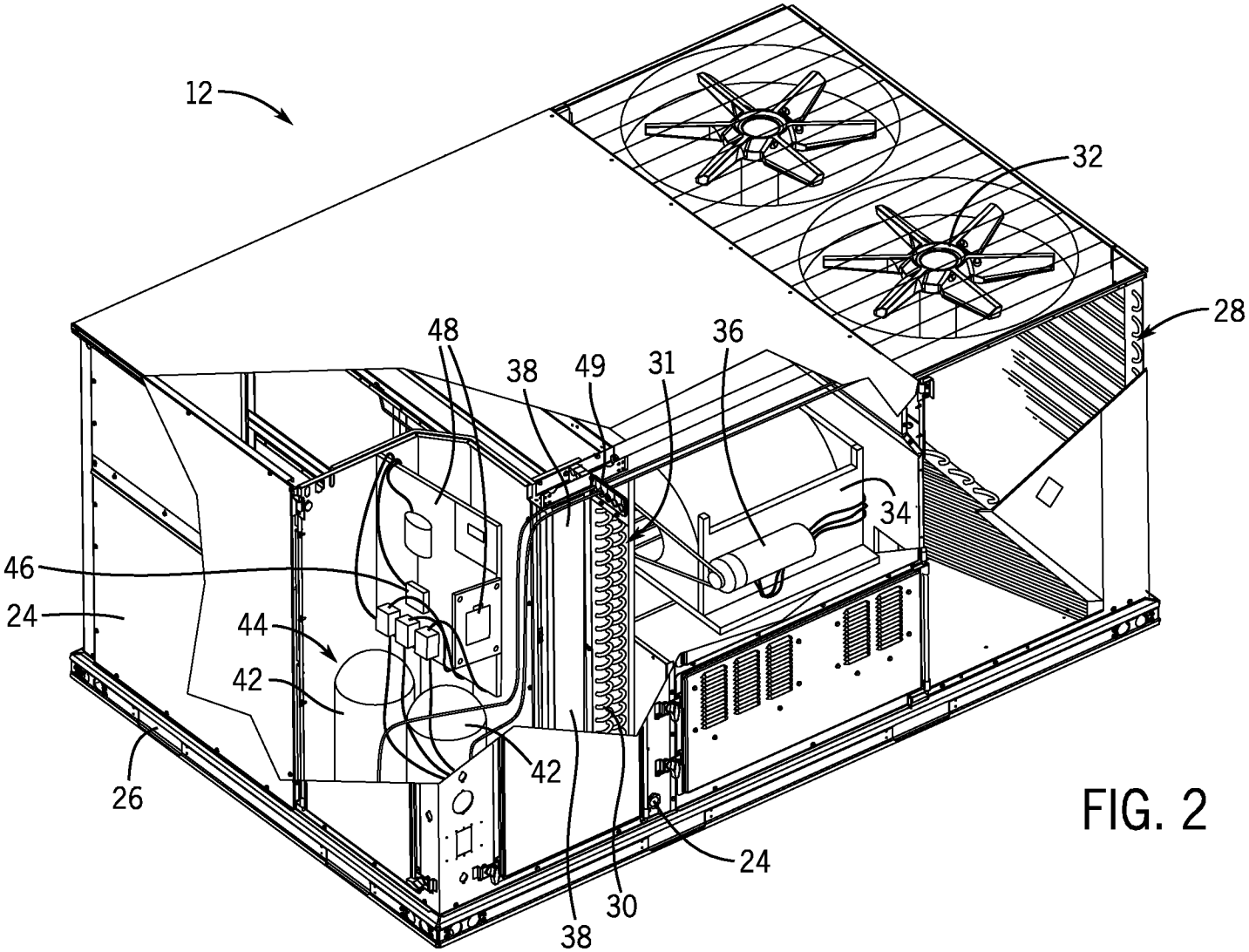
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
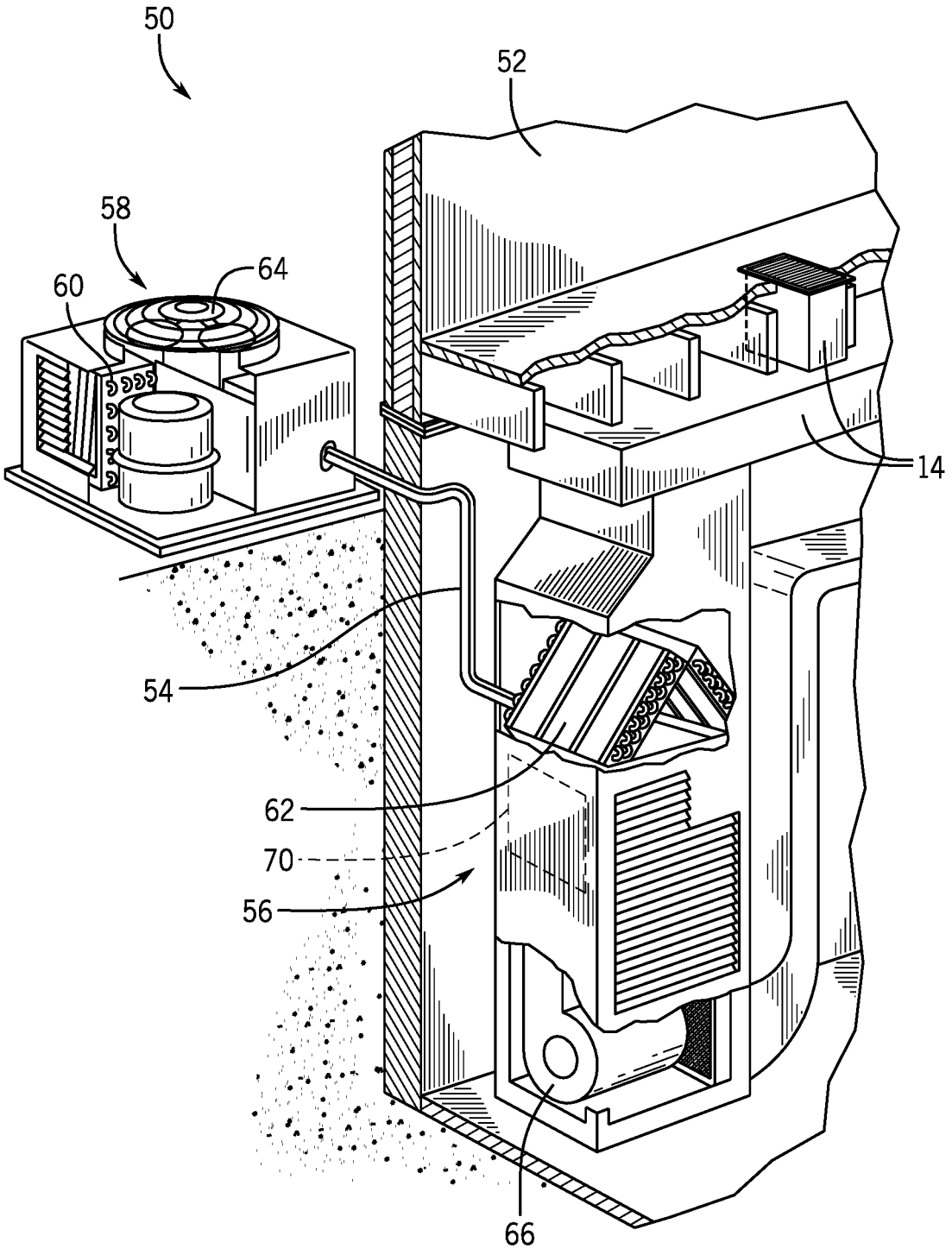
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
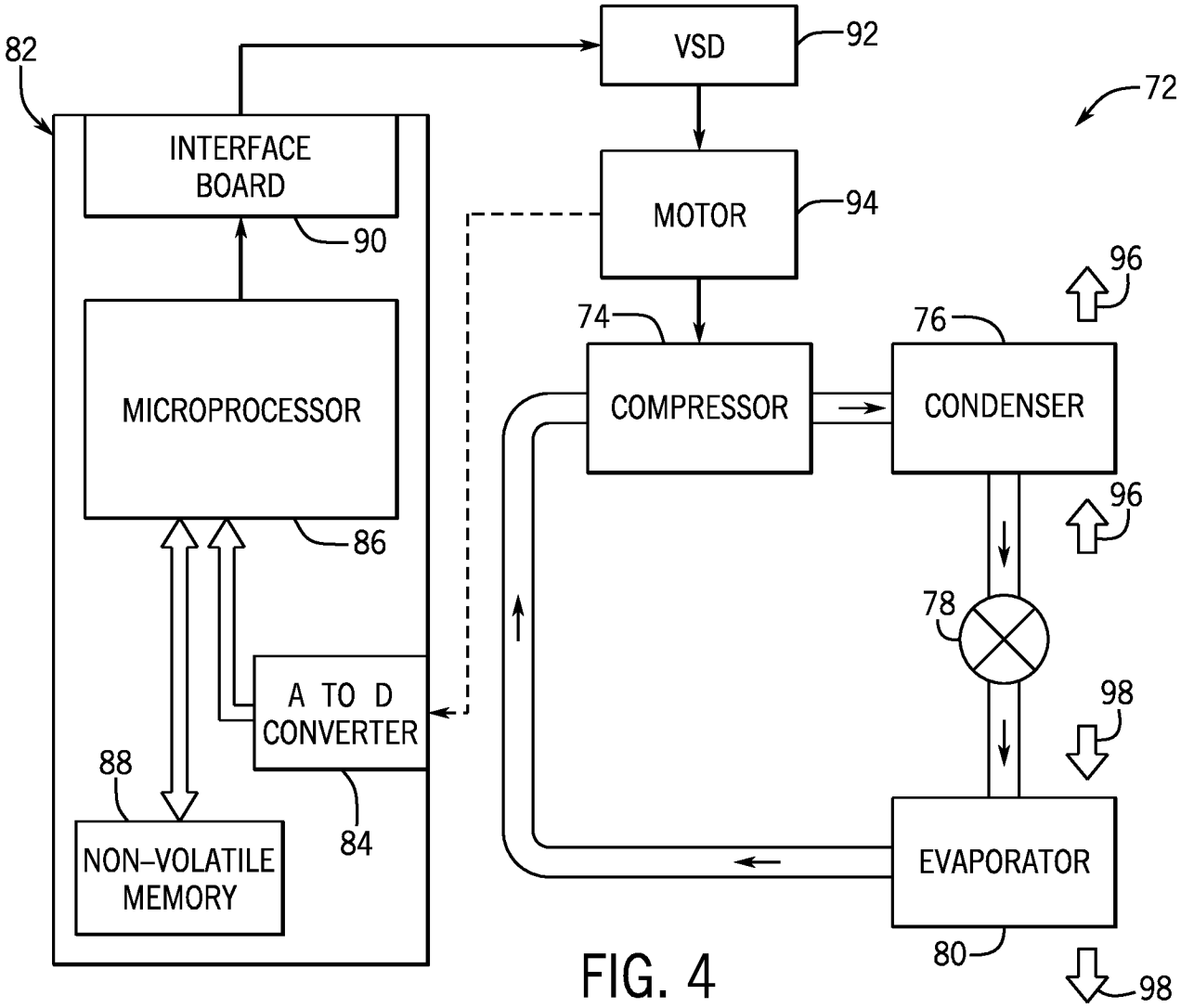
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

An HVAC system, such as the HVAC unit 12, may be fluidly coupled to a curb of a structure. As used herein, a "curb" refers to an interface between ductwork of the structure and the HVAC system. The curb may include openings extending through a wall, roof, ceiling, floor, or other portion of the structure. The openings enable the ductwork to be placed in fluid communication with the HVAC system and/or an ambient environment external to the structure. For example, the curb may include a first opening that is fluidly coupled to a first terminal end of a supply air duct within the structure and a second opening that is fluidly coupled to a second terminal end of a return air duct within the structure. The first opening may receive supply air, or conditioned air, from the HVAC system, and the supply air may ultimately be returned to the HVAC system, via the second opening, as return air.

As set forth above, curbs may include varying dimensions, configurations, shapes, and/or sizes, such that corresponding openings of the HVAC system may not be properly aligned with the first and second openings of the curb. As such, the HVAC system may include a curb assembly to facilitate coupling of the HVAC system to one of multiple curbs having different configurations, such as different openings, exterior dimensions, and so forth. In some embodiments, the curb assembly may include adjustable or flexible duct connectors that enable the corresponding openings of the HVAC system to be fluidly coupled to the openings of the curb when the corresponding openings of the HVAC system and the openings of the curb are not aligned, similarly sized, and/or coaxial with one another. Additionally, the curb assembly may include a pedestal system that supports a weight of the HVAC system and couples the HVAC system to an exterior surface or perimeter of the curb. As such, the curb assembly may enable the HVAC system to be coupled to the curb without a curb adapter that is specifically manufactured to couple a particular HVAC system to a particular curb. Although this disclosure primarily describes the curb assembly as coupling a rooftop unit to a curb, in additional or alternative embodiments, the curb assembly may couple another HVAC unit, such as an outdoor unit, to a curb positioned on a rooftop or other portion of a structure.

Figure 5:
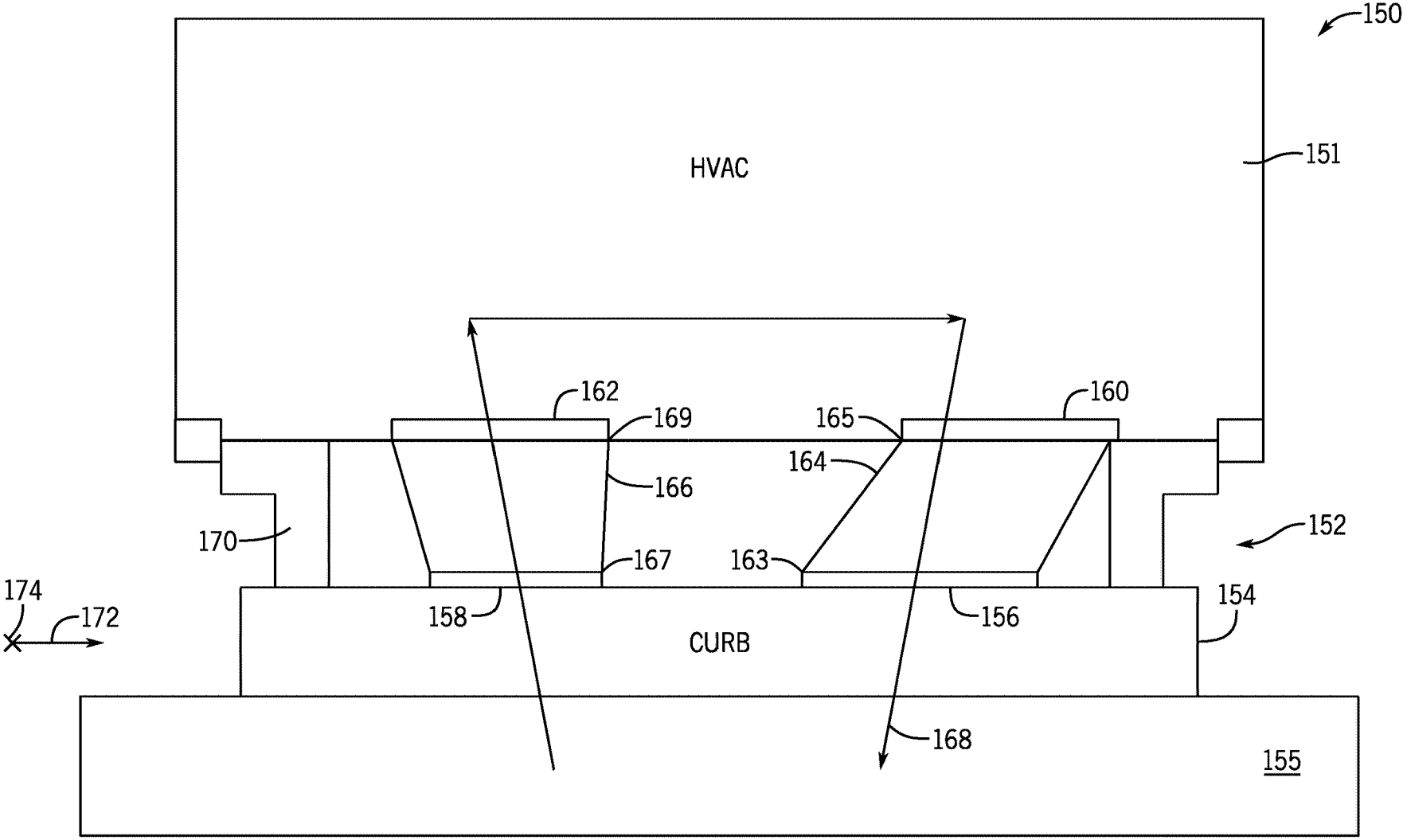
FIG. 5 is a schematic of an embodiment of an HVAC system having a curb assembly configured to facilitate coupling a housing of the HVAC system to a curb of a structure, in accordance with an aspect of the present disclosure.

FIG. 5 is a schematic of an embodiment of an HVAC system 150 having a curb adapter assembly 152 configured to facilitate coupling of a housing 151 of the HVAC system 150 to a curb 154 of a structure 155. The curb 154 may include air flow passages, such as a first opening 156 and a second opening 158, through which air may flow into and out of the structure 155, respectively. For example, supply air may flow from the housing 151 toward the structure 155, such as toward the ductwork 14 of the structure, through the first opening 156. Additionally, return air may flow from the structure 155, such as from the ductwork 14 of the structure 155, through the second opening 158 toward the housing 151. As such, the HVAC system 150 may be fluidly coupled to both the first opening 156 and the second opening 158. In some embodiments, the housing 151 may include an air flow outlet 160, which may be a supply air flow passage and is fluidly coupled to the first opening 156 extending through the curb 154. The housing 151 may also include an air flow inlet 162, which may be a return air flow passage, which is fluidly coupled to the second opening 158 extending through the curb 154. The air flow outlet 160 and the air flow inlet 162 may each be a channel, an opening, a pipe, a conduit, a tube, a passageway, or any combination thereof enabling air to flow into or out of the housing 151. In some embodiments, the curb adapter assembly 152 includes a first duct connector 164 and a second duct connector 166. The first duct connector 164 may fluidly couple the first opening 156 to the air flow outlet 160, and the second duct connector 166 may fluidly couple the second opening 158 to the air flow inlet 162.

In some embodiments, the first and second duct connectors 164, 166 may each be flexible or adjustable to accommodate and align with the first opening 156, the second opening 158, the air flow outlet 160, and/or the air flow inlet 162, each of which may be positioned differently in various types or configurations of housings 151 or curbs 154. For example, a first end 163 of the first duct connector 164 may be coupled to and aligned with the first opening 156, and a second end 165 of the first duct connector 164 may be coupled to and aligned with the air flow outlet 160. Thus, the first duct connector 164 may extend from the first opening 156 to the air flow outlet 160. Similarly, a third end 167 of the second duct connector 166 may be coupled to and aligned with the second opening 158, and a fourth end 169 of the second duct connector 166 may be coupled to and aligned with the air flow inlet 162. As such, the second duct connector 166 may extend from the second opening 156 to the air flow inlet 162. In some embodiments, the first and/or second duct connectors 164, 166 may include a retractable enclosure, such as a bellows, telescoping panels, and/or other suitable adjustable components to enable the first and second duct connectors 164, 166 to couple to the various openings when such openings have different sizes and/or are not coaxial with one another. For instance, the first and/or second duct connectors 164, 166 may be manipulated or adjusted to increase or decrease a cross-sectional area of the ends 163, 165, 167, 169 to match a corresponding cross-sectional area of the openings 156, 158 and the air flow outlet 160, and the air flow inlet 162, respectively. Additionally, the first and/or second duct connectors 164, 166 may be configured to move and/or adjust in length along a first axis 172 and/or a second axis 174 to enable the first duct connector 164 and the second duct connectors 166 to extend from the first opening 156 to the air flow outlet 160 and from the second opening 158 to the air flow inlet 162, respectively.

Further, the first and second duct connectors 164, 166 may each include an insulative material, such as polymer, fiberglass, another suitable material, or any combination thereof to block thermal energy transfer through the first and second duct connectors 164, 166. Coupling the HVAC system 150 to the curb 154 may establish an air flow path 168, in which return air may flow from the structure 155 through the second opening 158 and second duct connector 166 and toward the air flow inlet 162 and the housing 151. The HVAC system 150 may condition the return air and deliver conditioned air through the air flow outlet 160, into the first duct connector 164, and through the first opening 156 into the structure 155, such as into the ductwork 14 of the structure 155. In other embodiments, the return air, or a portion of the return air, may be exhausted into the ambient environment surrounding the HVAC system 150, and the HVAC system 150 may condition another portion of the return air and/or ambient air for supply to the structure 155.

Additionally, the curb adapter assembly 152 may include support beams 170 that are each configured to support a weight of the housing 151 and the components within the housing 151. For example, each support beam 170 may extend from the housing 151 to engage with the curb 154. In certain embodiments, each support beam 170 may couple to the curb 154 to block movement of the housing 151 relative to the curb 154. As such, the support beams 170 may enable the housing 151 to remain secured to the curb 154, such that the HVAC system 150 may circulate air through the structure 155. Specific details regarding the support beams 170 are further discussed herein with reference to FIG. 11.

Figure 6:
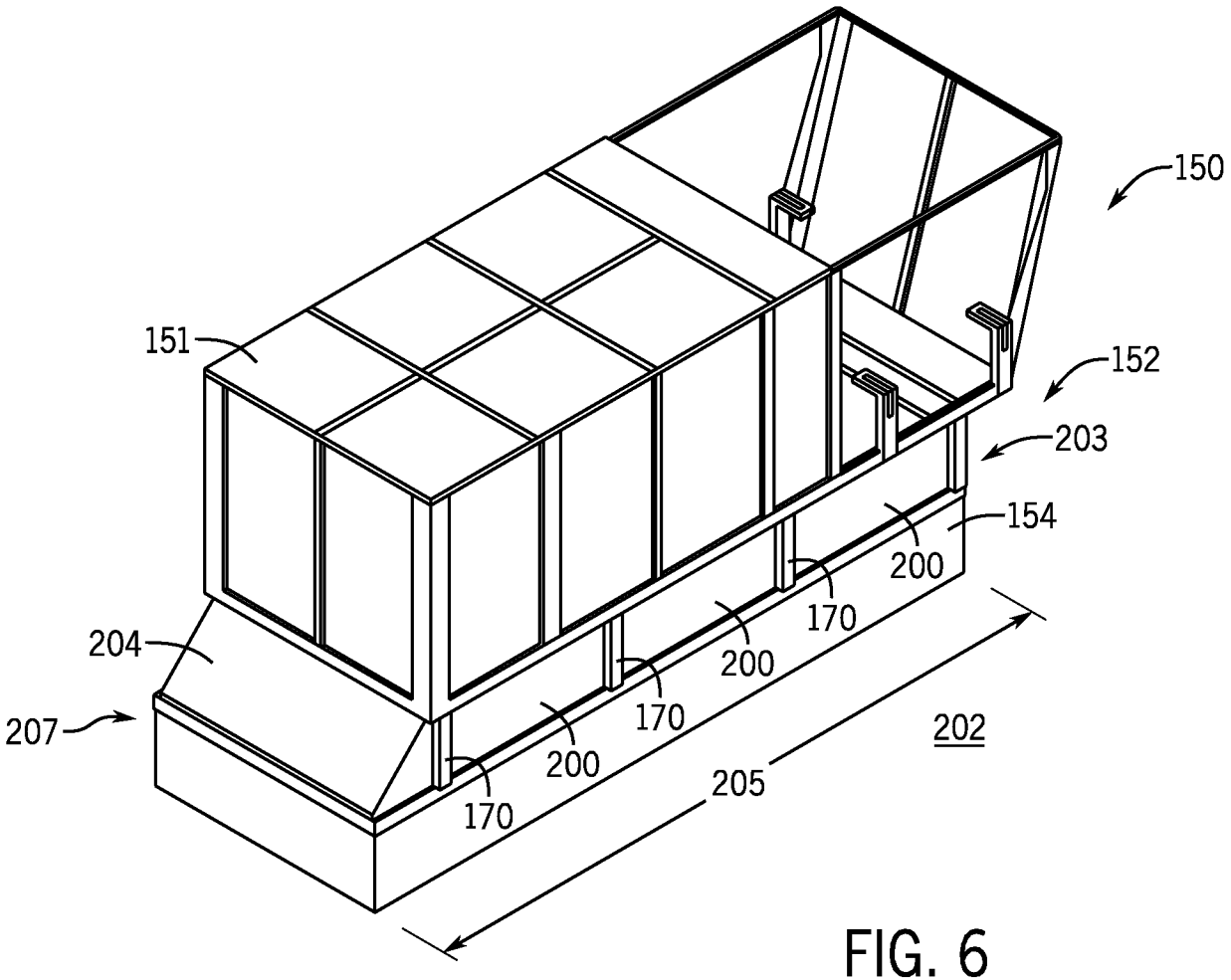
FIG. 6 is a perspective view of an embodiment of an HVAC system coupled to a curb via a curb assembly, in accordance with an aspect of the present disclosure.

FIG. 6 is a perspective view of an embodiment of the HVAC system 150 coupled to the curb 154 via the curb adapter assembly 152 in an installed configuration. In the installed configuration of the curb adapter assembly 152, the support beams 170 of the curb adapter assembly 152 may extend from the housing 151 to engage the curb 154 and support the weight of the HVAC system 150. The support beams 170 may maintain a position of the housing 151 that is offset from the curb 154 to form a space between the curb 154 and the housing 151. The curb adapter assembly 152 may include panels 200 that are disposed between each of the support beams 170 to cover or enclose the space formed between the housing 151 and the curb 154. The panels 200 may block fluid, such as precipitation and/or ambient air, from flowing into the curb assembly 154 from an ambient environment 202. In some embodiments, the support beams 170 and the panels 200 may be coupled to the housing 151 and/or to one another, and the support beams 170 and the panels 200 may collectively be considered or referred to as a pedestal system 203. In the illustrated embodiment of FIG. 6, the pedestal system 203 of the curb adapter assembly 152 includes four support beams 170 and three panels 200 disposed along a length 205 of one side of the HVAC system 150, but in additional or alternative embodiments, the pedestal system 203 may include any suitable number of support beams 170 and panels 200 to enclose the space between the housing 151 and the curb 154. In some embodiments, additional cover panels 204 may be disposed at an end 207 of the HVAC system 150 to cover a remaining space between the housing 151 and the curb 154 that may not otherwise be covered by the panels 200 on other sides of the curb adapter assembly 152.

Figure 7:
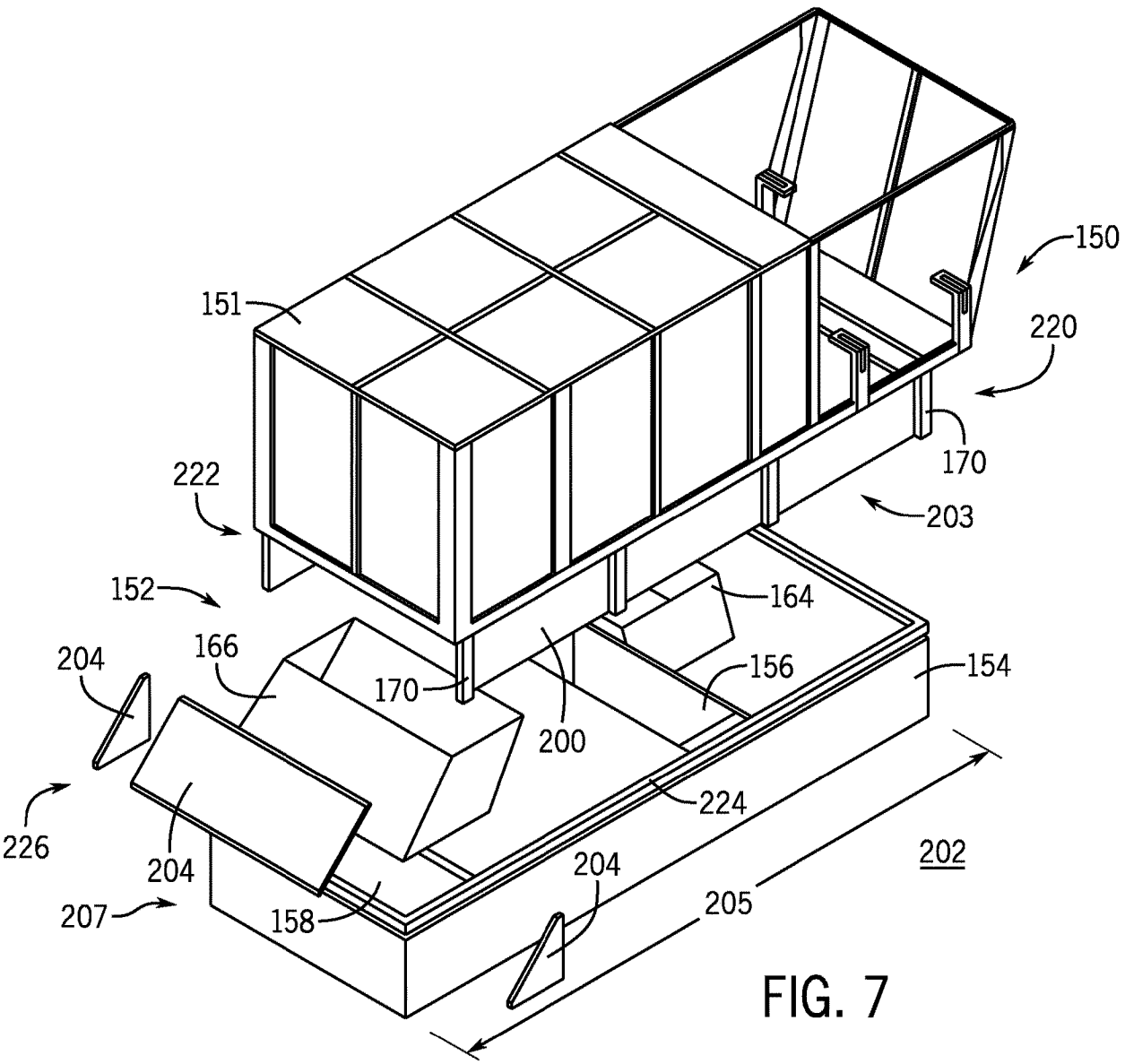
FIG. 7 is an exploded perspective view of an embodiment of the HVAC system and the curb assembly of FIG. 6, in accordance with an aspect of the present disclosure.

FIG. 7 is an exploded perspective view of an embodiment of the HVAC system 150, the curb 154, and the curb adapter assembly 152. As shown in FIG. 7, the support beams 170 and the panels 200 may each be coupled to at least a portion of a first side 220 and a second side 222 extending along the length 205 of the housing 151. Additionally, a frame 224 may be coupled to the curb 154, such as adjacent at least a portion of an external perimeter of the curb 154. The first duct connector 164 and the second duct connector 166 may be positioned in the space formed between the housing 151 and the curb 154 or the frame 224 and may fluidly couple the first opening 156 and the second opening 158 of the curb 154, respectively, to the housing 151.

In FIG. 7, the cover panels 204 may be positioned at a third side 226 extending crosswise to the length 205 and at one of the ends 207 of the housing 151 and may generally cover an opening at the third side 226 between the housing 151 and the curb 154. Thus, the cover panels 204 block fluid from flowing between the ambient environment 202 and an interior of the curb adapter assembly 152 via the opening at the third side 226. The illustrated embodiment includes three cover panels 204 that may be coupled to one another, the frame 224, the housing 151, and/or the support beams 170 to cover the opening on the third side 226. However, alternative embodiments may include any number and/or shapes of cover panels 204 that block fluid from flowing between the ambient environment 202 and the interior of the curb adapter assembly 152.

It should be noted that existing HVAC systems 150 or curbs 154 may be retrofitted with certain components of the curb adapter assembly 152. For example, a kit that includes the duct connectors 164, 166, the support beams 170, the panels 200, the cover panels 204, and/or the frame 224 may be coupled to an existing housing 151 and/or an existing curb 154. In this manner, a variety of housings 151 may utilize the curb adapter assembly 152 to couple to multiple curbs 154 having different configurations and/or dimensions.

Figure 8:
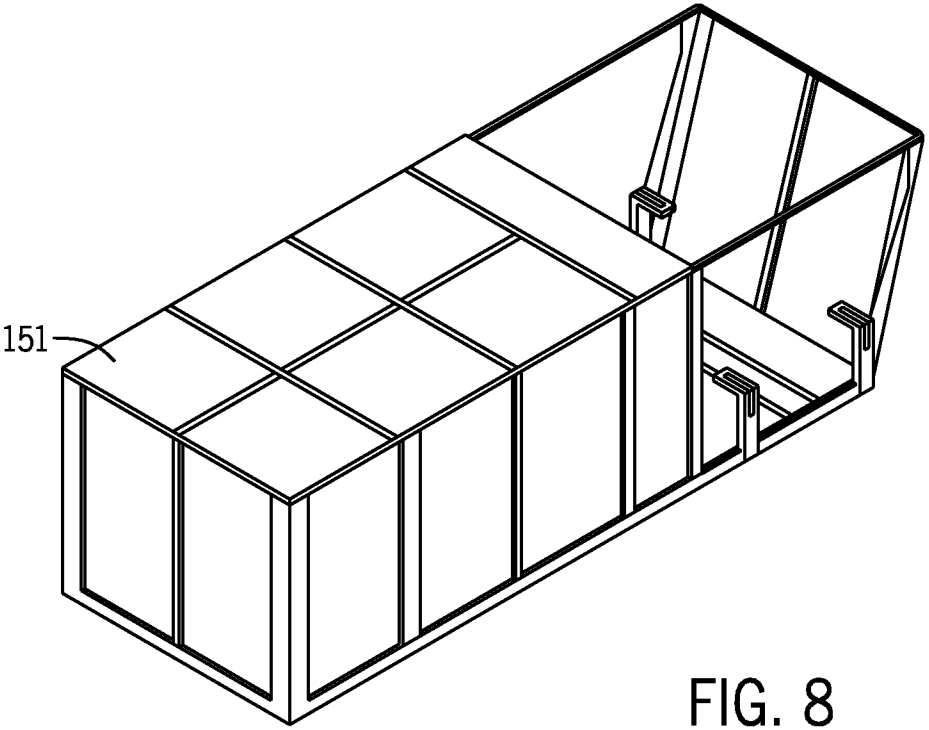
FIG. 8 is a perspective view of an embodiment of a housing of an HVAC system in a compact configuration, in accordance with an aspect of the present disclosure.

In certain embodiments, the support beams 170 and the panels 200 may be adjustable relative to the housing 151. For example, FIG. 8 is a perspective view of an embodiment of the housing 151 in a compact configuration. In the compact configuration of the housing 151, the pedestal system 203 does not extend from the housing 151 and thus, the pedestal system 203 is not shown in FIG. 8. The compact configuration of the housing 151 may reduce an overall size, height, or volume of the housing 151. For instance, the compact configuration of the housing 151 may decrease a physical footprint of the housing 151 to facilitate transportation or shipment of the HVAC system 150. In some embodiments, the support beams 170 and the panels 200 may be hingedly coupled to the housing 151 and may be folded or rotated about an axis to transition the housing 151 to the compact configuration. Thus, the pedestal system 203 may be positioned to be adjacent to a bottom surface of the housing 151 in the compact configuration of the housing 151. In additional or alternative embodiments, the support beams 170 and the panels 200 may be removably coupled to the housing 151, such that pedestal system 203 is removed from the housing 151 to transition the housing 151 into the compact configuration. Transitioning the housing 151 between an extended configuration and the compacted configuration is described in further detail herein with reference to FIG. 12.

Figure 9:
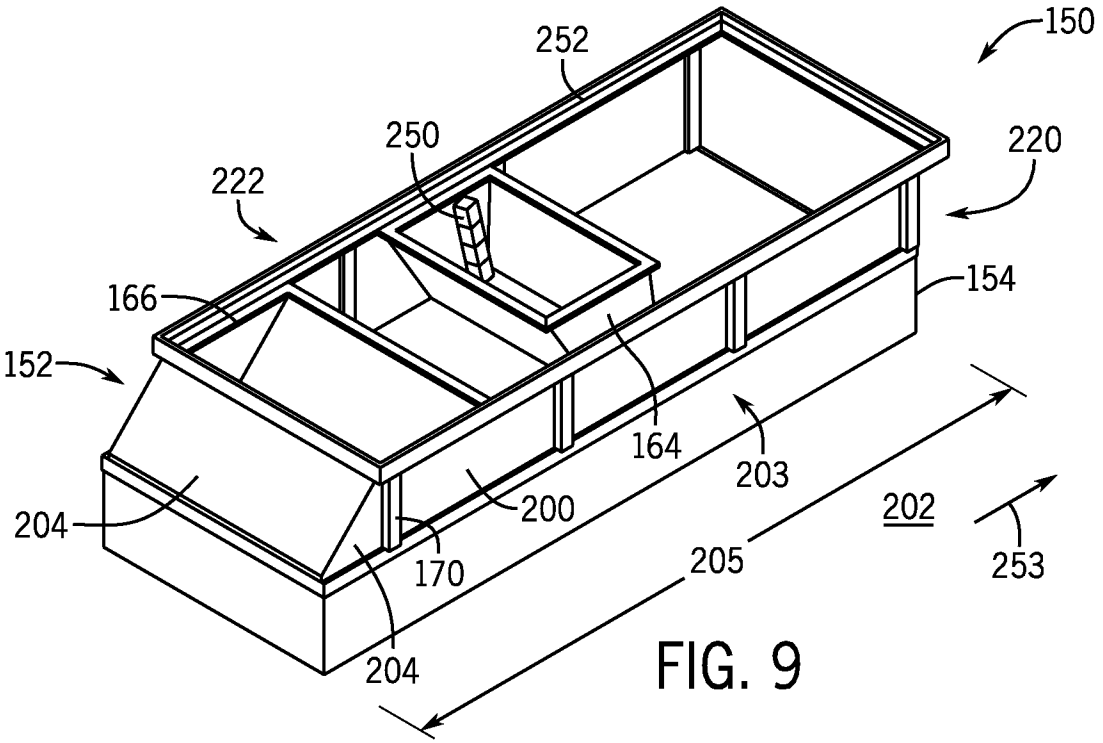
FIG. 9 is a perspective view of an embodiment of a curb assembly in an installed configuration, in accordance with an aspect of the present disclosure.

FIG. 9 is a perspective view of an embodiment of the curb adapter assembly 152 in an installed configuration. In FIG. 9, the housing 151 is removed to show the connections between the curb adapter assembly 152 and the curb 154, as well as a space formed between the curb 154 and the housing 151. The first duct connector 164 and the second duct connector 166 are each in an extended position that is configured to couple the first opening 156 to the air flow outlet 160 of the housing 151 and the second opening 158 to the air flow inlet 162 of the housing 151. In some embodiments, the first duct connector 164 and/or the second duct connector 166 may be maintained in the extended positions by respectively coupling the first duct connector 164 and/or the second duct connector 166 to the support beams 170 and/or the panels 200. In additional or alternative embodiments, the extended positions of the first duct connector 164 and/or the second duct connector 166 may be maintained via a locking mechanism or other support elements. For example, the first duct connector 164 and/or the second duct connector 166 may each have a stabilizing rod 250 coupled to a side of the respective first duct connector 164 and/or the second duct connector 166. The stabilizing rod 250 may be foldable, slidable, telescoping, or otherwise adjustable to extend along the respective side of the first duct connector 164 and/or the second duct connector 166 to provide structural support to the first duct connector 164 and/or the second duct connector 166. When a desired target position of the first duct connector 164 and/or the second duct connector 166 is set, a position of the respective stabilizing rod 250 may be adjusted to maintain the target position of the duct connectors 164, 166. The target position of the duct connectors 164, 166 may correspond to a position of the corresponding air flow outlet or inlet 160, 162 of the housing, such that the second end 165 of the first duct connector 164 and the fourth end 169 of the second duct connector 166 are aligned with a position of the air flow outlet 160 and the air flow inlet 162, respectively. In other words, the respective stabilizing rods 250 support the duct connectors 164, 166 and restrict movement of the respective duct connectors 164, 166 to maintain the duct connectors 164, 166 in the target position as the housing 151 is installed on the curb 154.

As illustrated in FIG. 9, the pedestal system 203 may include or be coupled with a mounting frame 252 of the HVAC system 150 that extends adjacent to an external perimeter of the housing 151. The mounting frame 252 is configured to align with at least a portion of the curb 154, such as a portion of the external perimeter of the curb 154. For example, the mounting frame 252 may be substantially aligned with the external perimeter of the curb 154 along an axis 253 defining the length 205 of the HVAC system 150 to enable the support beams 170 and the panels 200 to align with the frame 224 in the extended configuration of the housing 151. Other portions of the mounting frame 252 may additionally or alternatively align with the external perimeter of the curb 154 and/or the frame 224. The mounting frame 252 may be a part of, or may be coupled to, the housing 151. In some embodiments, the panels 200 and/or the cover panels 204 may also be coupled to the mounting frame 252, which may further enclose the space between the housing 151 and the curb 154 to block the flow of fluid between the ambient environment 202 and the interior of the curb adapter assembly 152.

Figure 10:
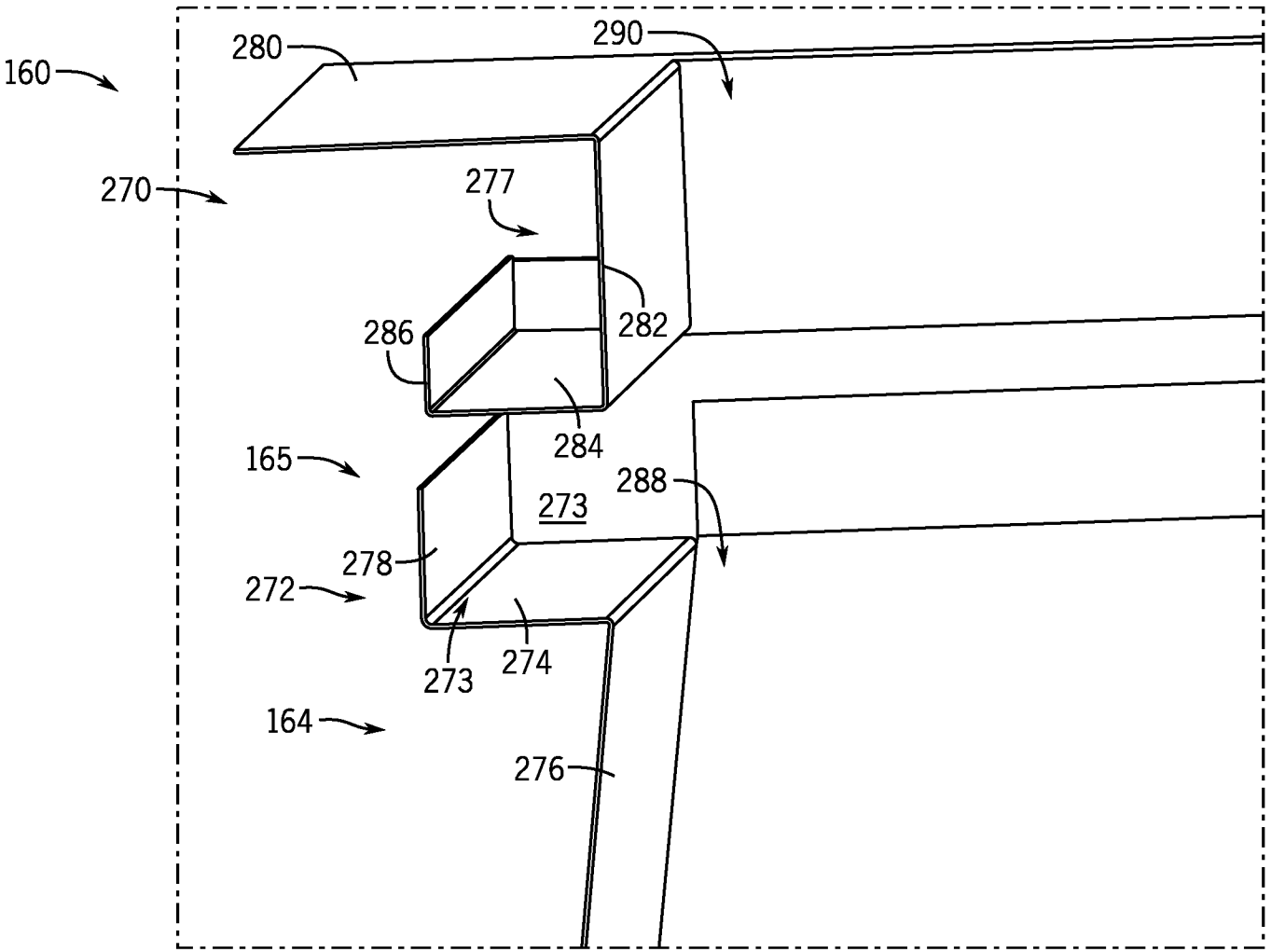
FIG. 10 is a cross-sectional perspective view of an embodiment of a duct flange of a housing of an HVAC system configured to engage a duct connector of a curb assembly, in accordance with an aspect of the present disclosure.

FIG. 10 is a cross-sectional perspective view of an embodiment of an air flow passage mount 270 of one of the openings of the housing 151, such as the air flow outlet 160 or the air flow inlet 162 that is configured to engage with one of the duct connectors 164, 166. For purposes of discussion, the disclosure will describe FIG. 10 with respect to the first duct connector 164 and the air flow outlet 160, but it should be noted that the discussion of FIG. 10 may additionally or alternatively be applied to the second duct connector 166 and the air flow inlet 162. As shown in FIG. 10, the first duct connector 164 may include a flange 272 surrounding at least a portion of a perimeter of the first duct connector 164 that is configured to sealingly engage with a corresponding shape of the air flow passage mount 270. Thus, the air flow passage mount 270 and/or the flange 272 may each be considered a gasket to block air from flowing out between the engagement of the air flow outlet 160 and the first duct connector 164. For example, a shape of the flange 272 may be configured to capture or receive the air flow passage mount 270 in the installed configuration of the curb adapter assembly 152. The air flow passage mount 270 may be disposed within a recessed portion 273 of the flange 272 to form a seal between the housing 151 and the first duct connector 164 to block air from flowing between the air flow passage mount 270 and the flange 272. In some embodiments, the flange 272 has an L-shaped seat having a first segment 274 extending substantially crosswise from a wall 276 of the first duct connector 164 and a second segment 278 extending crosswise from the first segment 274 and offset from the wall 276 of the first duct connector 164. The first segment 272 and the second segment 274 form the recessed portion 273 that is configured to receive and form a seal with the air flow passage mount 270. Moreover, the air flow passage mount 270 may have flange 277 that includes a J-shaped cross section that may be disposed within the recessed portion 273 of the flange 272. For instance, the air flow passage mount 270 may also include a coupling flange 280 that is configured to couple to, or is integral to, the housing 151. The flange 277 of the air flow passage mount 270 may include a first portion 282 extending crosswise from the coupling flange 280, a second portion 284 extending crosswise from the first portion 282, and a third portion 286 extending crosswise from the second portion 284 toward the coupling flange 280.

In the installed configuration of the curb adapter assembly 152, the second portion 284 of the air flow passage mount 270 may abut or be supported by the first segment 274 of the first duct connector 164, and the third portion 286 of the air flow passage mount 270 may abut or be positioned adjacent to the second segment 278. As such, the flange 272 may receive and capture the air flow passage mount 270 to block air from flowing out of the mount between the flange 272 and the air flow passage mount 270, thereby maintaining or confining a flow of air within the air flow path 168. In additional or alternative embodiments, the flange 272 and/or the air flow passage mount 270 may have different shapes that would enable the flange 272 to capture the air flow passage mount 270 to block or restrict air flow out of the interface between the flange 272 and the air flow passage mount 270. Moreover, additional material, such as caulk, may additionally be disposed between the flange 272 and the air flow passage mount 270 to form a seal between the flange 272 and the flange 277, and may further block air from flowing between the flange 272 and the air flow passage mount 270. In certain embodiments, the flange 272, such as the second segment 278, may additionally be coupled to the air flow passage mount 270, such as to the third portion 286, to provide additional securement between the flange 272 and the air flow passage mount 270.

In some embodiments, the position of the first duct connector 164 and/or the second duct connector 166 may be set before the housing 151 is coupled to the curb 154. For instance, prior to disposing the housing 151 onto the curb 154, the first end 163 of the first duct connector 164 may be coupled to the first opening 156. The first duct connector 164 may then be adjusted and set to position the second end 165 of the first duct connector 164 to a first target position. Similarly, the third end 167 of the second duct connector 166 may be coupled to the second opening 158. The second duct connector 166 may then be adjusted and set to position the fourth end 169 of the second duct connector 166 to a second target position. The housing 151 may then be disposed onto the curb 154, and the air flow outlet 160 may be aligned with and engage the second end 165 of the first duct connector 164, and the air flow inlet 162 may be aligned with and engage the fourth end 169 of the second duct connector 166 without having to move either the first duct connector 164 or the second duct connector 166.

Figure 11:
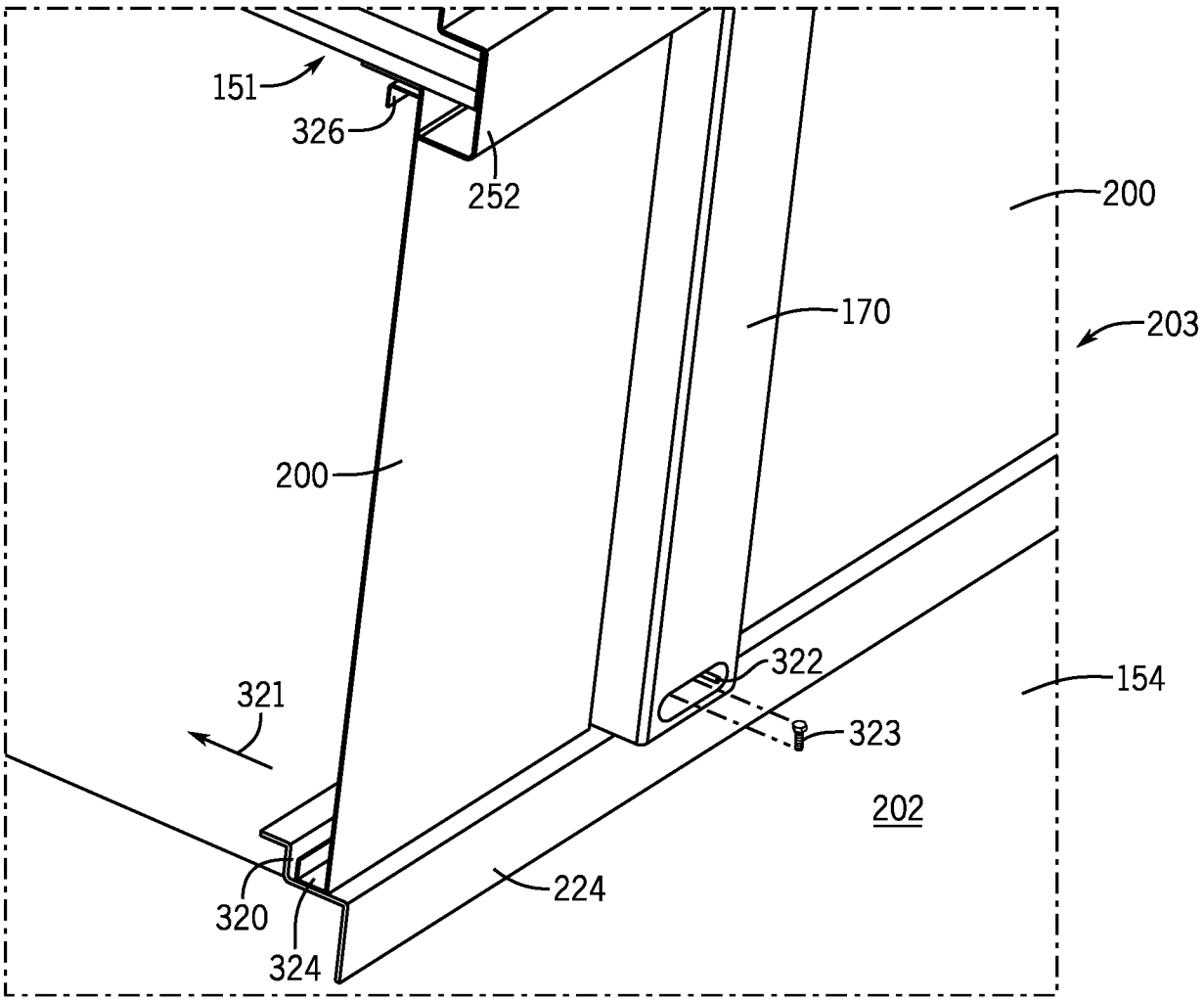
FIG. 11 is a partial perspective view of an embodiment of a pedestal system of a curb assembly in an installed configuration, in accordance with an aspect of the present disclosure.

FIG. 11 is a perspective partial view of an embodiment of the pedestal system 203 in an installed configuration of the curb adapter assembly 152. The support beam 170 may extend from the mounting frame 252 to the frame 224 in the installed configuration of the curb adapter assembly 152. In some embodiments, the frame 224 may include a frame flange 320 that is configured to engage a portion of the support beam 170. For example, the frame flange 320 may block movement of the support beam 170 in a first direction 321. Moreover, the support beam 170 may include an aperture, opening, or slot 322, which is configured to receive a fastener 323 that secures the support beam 170 to the frame 224. For instance, the fastener 323 may be inserted into the aperture 322 and through respective openings of the support beam 170 and the frame 224 to fasten and/or couple the support beam 170 to the frame 224. As such, the fastener 323 further blocks movement of the support beam 170 relative to the frame 224. Additionally or alternatively, the support beam 170 may be coupled to the frame 224 using other suitable techniques, such as via a weld, an adhesive, and the like to block movement of the support beam 170 relative to the frame 224.

The panels 200 may be configured to extend between the frame 224 and the mounting frame 252. In the illustrated embodiment, one of the panels 200 is shown to have a panel flange 324 that may also engage the frame flange 320 of the frame 224. An end 326 of the panel 200 that is located on an opposite end of the panel 200 from the panel flange 324 may be configured to engage the mounting frame 252 and the housing 151. The engagement between the panel flange 324 and the frame flange 320 and between the end 326 of the panel 200 and the mounting frame 252 may further block fluid flow between the ambient environment 202 and the space between the housing 151 and the curb 154 enclosed by the curb adapter assembly 152.

Figure 12:
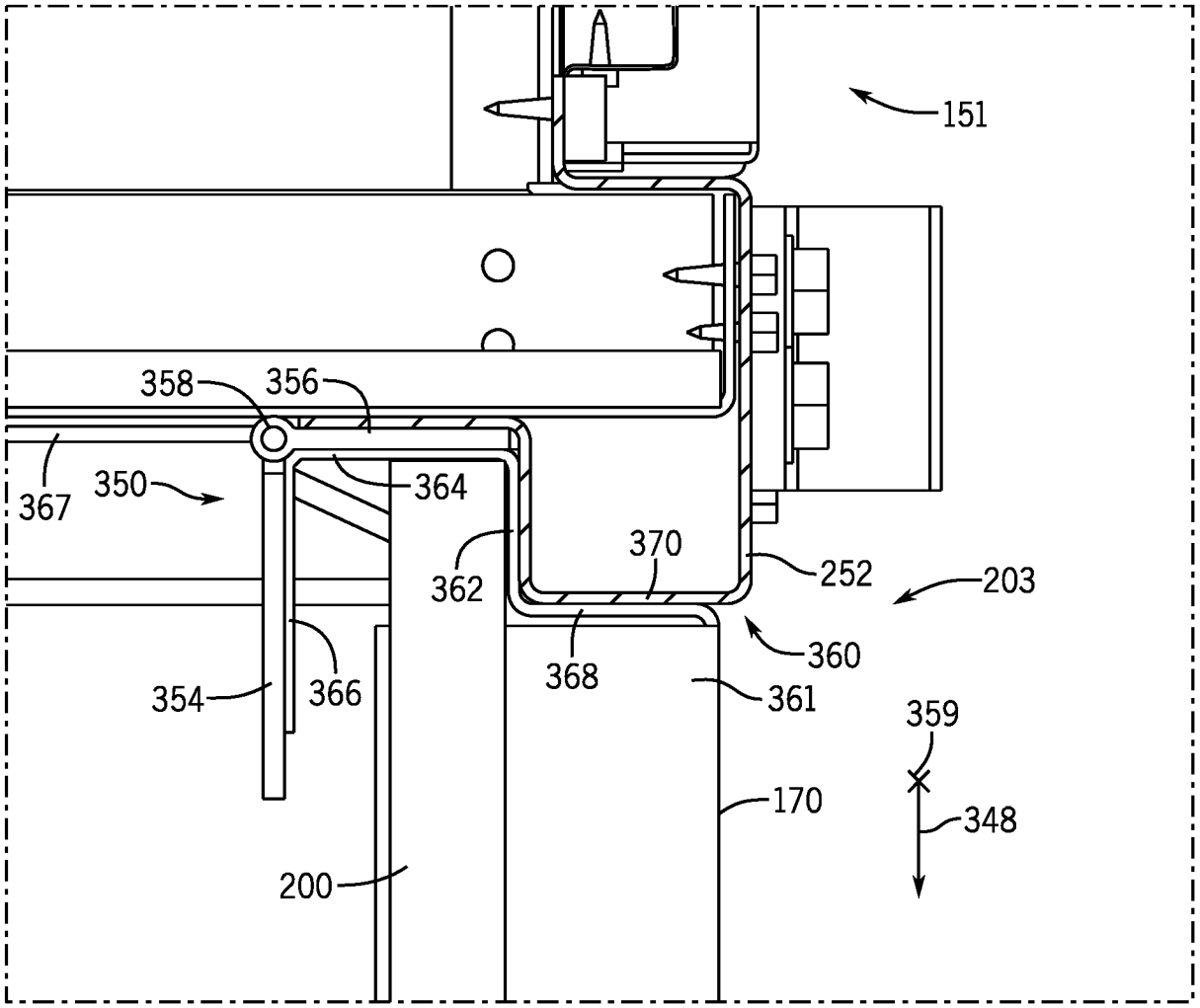
FIG. 12 is a cross-sectional side view of an embodiment of a housing of an HVAC system in an extended configuration, in accordance with an aspect of the present disclosure.

FIG. 12 is a cross-sectional side view of an embodiment of the housing 151 in an extended configuration, in which the support beams 170 and/or the panels 200 of the pedestal system 203 generally extend along a vertical axis 348 away from the housing 151 to enable the pedestal system 203 to couple to the curb 154. In the illustrated embodiment, the support beams 170 and/or the panels 200 of the pedestal system 203 are hingedly coupled to the mounting frame 252. For example, the pedestal system 203 may include a hinge 350 coupled to the support beams 170 and/or the panels 200. The hinge 350 may include a first plate 354 and a second plate 356, in which the first plate 354 and the second plate 356 may rotate relative to one another about a pivot 358, which may be a rod or a bolt, and about a rotational axis extending in a direction 359. The second plate 356 may be coupled to the mounting frame 252, such as via fasteners, welds, adhesives, another suitable coupling technique, or any combination thereof. Furthermore, each support beam 170 may have an extension member 360 coupled to the first plate 354 of the hinge 350, thereby coupling the support beams 170 to the mounting frame 252. The extension member 360 may have a C-shaped cross section that includes a first section 362 extending from a body 361 of the extension member 360, a second section 364 extending crosswise from the first section 362, and a third section 366 extending crosswise from the second section 364. The third section 366 may be configured to couple to the first plate 354 of the hinge 350 to couple the respective support beam 170 to the mounting frame 252.

In the extended configuration of the housing 151, the first plate 354 may be substantially perpendicular to the second plate 356, such that the second section 364 of the extension member 360 abuts the second plate 356 of the hinge 350, and the first section 362 of the extension member 360 abuts the mounting frame 252 of the housing 151. As such, in the extended configuration of the housing 151, the extension member 360 may be captured between the first plate 354 and the mounting frame 252, and the support beam 170 may be oriented approximately perpendicularly with respect to a base surface 367 of the housing 151 to extend away from the base surface 367. Moreover, in the extended configuration of the housing 151, a top or end 368 of the support beam 170 may engage with a surface 370 of the mounting frame 252, such that the support beam 170 supports the weight of the housing 151 and the HVAC system 150. In the installed configuration of the curb adapter assembly 152, the weight of the housing 151 and the components within the housing 151 may cause the top 368 of the support beam 170 to remain substantially flush with the surface 370 of the mounting frame 252 and may further maintain the position of the housing 151 in the extended position.

Figure 13:
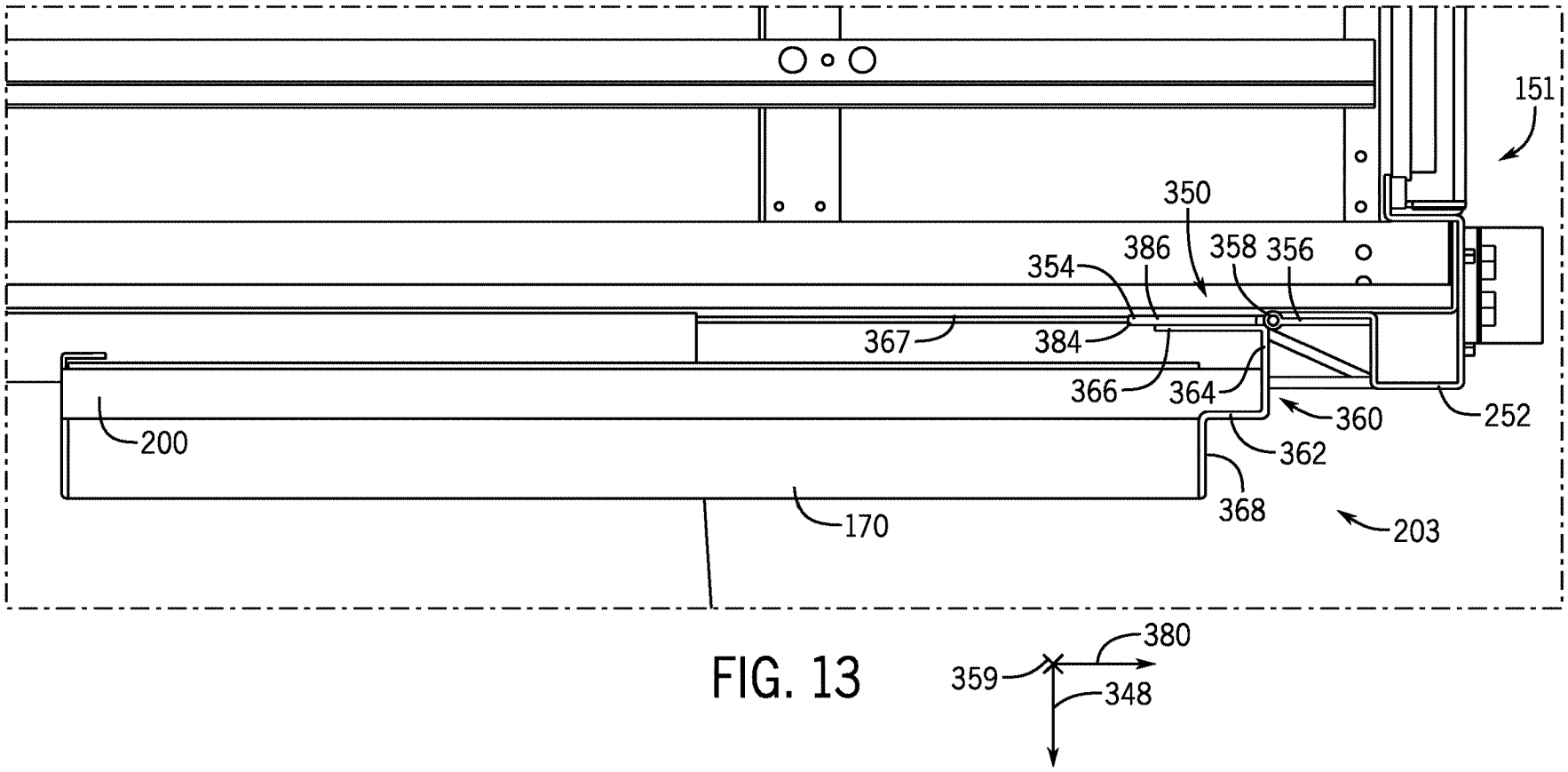
FIG. 13 is a cross-sectional side view of an embodiment of the housing of the HVAC system of FIG. 12 in a compact configuration, in accordance with an aspect of the present disclosure.

FIG. 13 is a cross-sectional side view of an embodiment of the housing 151 in a compact configuration, in which the pedestal system 203 generally extends along a lateral or longitudinal axis 380 relative to the housing 151, which may decrease a volume of the housing 151. In the compact configuration of the housing 151, the first plate 354 of the hinge 350 may be rotated about the pivot 358 and about the rotational axis extending in the direction 359 to substantially align with the second plate 356 along the lateral or longitudinal axis 380. As such, the support beams 170 and the panels 200 may extend approximately parallel to and along the base surface 367. The second plate 356 may remain fixed to the mounting frame 252 when transitioning the housing 151 between the extended and the compact configurations. In some embodiments, the housing 151 and/or the pedestal system 203 may include a mechanism to enable the housing 151 to be secured or maintained in the compact configuration. By way of example, a distal end 384 and/or a surface 386 of the first plate 354 may be configured to be removably coupled to the base surface 367 of the housing 151. More specifically, the distal end 384 and/or the surface 386 of the first plate 354 may be coupled to the base surface 367 to maintain the alignment of the first plate 354 with the second plate 356 along the lateral or longitudinal axis 380 and to maintain the position of the housing 151 in the compacted configuration. The first plate 354 may then be decoupled from the base surface 367, while the second plate 354 remains coupled to the mounting frame 252, to enable the first plate 354 and the pedestal system 203 to rotate relative to the housing 151 and transition the housing 151 to the extended configuration. In additional or alternative embodiments, another suitable mechanism or locking device may be used to maintain the position of the housing 151 in the compact configuration and/or the extended configuration. In further embodiments, the support beams 170 and/or the panels 200 may be completely removed from the housing 151 to transition the housing 151 between the extended configuration to the compact configuration.

Figure 14:
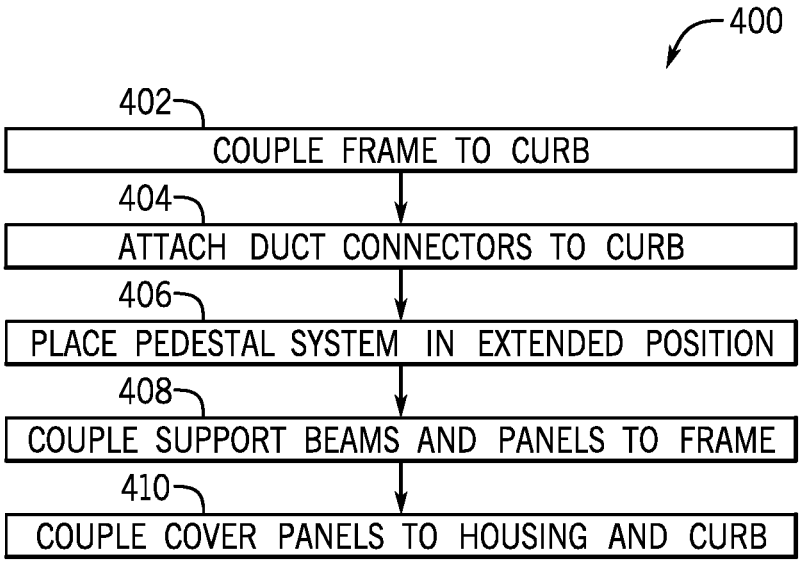
FIG. 14 is a flowchart of a method or process for coupling a housing of an HVAC system to a curb via a curb assembly, in accordance with an aspect of the present disclosure.

FIG. 14 is a flowchart of an embodiment of a method or process 400 for coupling the housing 151 to the curb 154 via the curb adapter assembly 152. It should be noted that, in additional or alternative embodiments, other steps may be performed in addition to the method 400, or certain steps of the depicted method 400 may be modified, removed, or performed in a different order than shown in the illustrated embodiment of FIG. 14.

Blocks 402 and 404 are each associated with preparing the curb 154 to receive the housing 151. For example, at block 402, the frame 224 is coupled to the curb 154. In some embodiments, the frame 224 may be disposed onto an external perimeter of the curb 154 and coupled to the curb 154 via fasteners, adhesives, welds, press fitting, or another suitable coupling technique. At block 404, the duct connectors 164, 166 are attached to the curb 154. That is, the first end 163 of the first duct connector 164 may be aligned with and coupled to the first opening 156 of the curb 154, and the third end 167 of the second duct connector 166 may be aligned with and be coupled to the second opening 158 of the curb 154.

At block 406, the housing 151 may be positioned in a location to prepare for coupling the housing 151 to the curb 154. For example, the housing 151 may be suspended vertically above the curb 154, such as via a crane or another suitable device, and the housing 151 may be in the extended configuration. In other words, the first plate 354 of the hinge 350 may be rotated until the support beams 170 and panels 200 may extend away from the housing 151 along the vertical axis 348. As mentioned, in the extended configuration of the housing 151, the support beams 170 and/or the panels 200 may be oriented approximately perpendicular with the base 367 of the housing 151.

At block 408, the support beams 170 and panels 200 of the pedestal system 203 may be coupled to the frame 224. For example, each support beam 170 may extend from the mounting frame 252 and abut the frame 224. Additionally, a fastener may be inserted within each aperture 322 of the respective support beams 170 to further secure the housing 151 to the frame 224. Moreover, each panel 200 may be positioned to engage the frame flange 320 of the frame 224. For example, the panel 200 may abut the frame flange 320 to secure the panel 200 to the frame 224 and block movement of the panel 200 relative to the frame 224, such as along the lateral or longitudinal axis 380. In any case, coupling the pedestal system 203 to the frame 224 may substantially block fluid flow between the ambient environment 202 and the space between the housing 151 and the curb 154. In some embodiments, the air flow outlet 160 and the air flow inlet 162 may automatically engage with the duct connectors 164, 166, respectively, when the support beams 170 and the panels 200 are coupled to the frame 224. For instance, the first duct connector 164 may be extended to a position that aligns the second end 165 of the first duct connector 164 and the air flow outlet 160 of the housing 151. Thus, the first duct connector 164 fluidly couples the first opening 156 to the air flow outlet 160. Further, the second duct connector 166 may be extended to a position that aligns the fourth end 169 of the second duct connector 166 and the air flow inlet 162 of the housing 151. In this manner, the second duct connector 166 fluidly couples the second opening 158 to the air flow inlet 162. The respective air flow passage mounts 270 of the air flow outlet 160 and air flow inlet 162 may engage with the respective flanges 272 of the duct connectors 164, 166 to block air from flowing out of the duct connectors 164, 166 and the air flow path 168. In certain embodiments, additional components, such as fasteners, adhesives, welds, tabs, another suitable coupling technique, or any combination thereof, may be included that further couple the air flow passage mounts 270 to each respective flange 272. In further embodiments, caulk or another sealing material may be placed at the interface between the air flow passage mounts 270 and the respective flanges 272, which may further block air from flowing out of the air flow path 168.

At block 410, the cover panels 204 are coupled to the housing 151 and the frame 224 to cover any remaining spaces or gaps between the housing 151 and the curb 154 that may not be covered by the support beams 170 and/or the panels 200. For example, the cover panels 204 may be disposed at ends 207 of the housing 151 that do not have the support beams 170 and/or the panels 200 of the pedestal system 203. Each cover panel 204 may be inserted into the frame 224, such as against the frame flange 320 of the frame 224, to couple the cover panel 204 to the curb 154. Additionally, each cover panel 204 may be secured to the mounting frame 252 to couple the cover panel 204 to the housing 151. After the cover panels 204 are coupled to the housing 151 and the frame 224, the pedestal system 203 and the cover panels 204 may collectively block fluid from flowing between the ambient environment 202 and the interior of the curb adapter assembly 152.

The present disclosure is directed to an HVAC system that has a curb assembly to facilitate coupling a housing of the HVAC system to a curb of a structure. The curb assembly enables air to circulate between the structure and the HVAC system and enables the HVAC system to condition the structure. The curb assembly may include a frame configured to couple to at least an external perimeter of the curb. Moreover, the curb assembly may include support beams that couple to the frame and support a weight of the housing and the components contained therein. The housing may be positioned such that the support beams extend from the curb to the housing to form a space within the curb assembly between the housing and the curb. In addition, the curb assembly may include duct connectors disposed in the space between the housing and the curb. Each duct connector may fluidly couple a respective opening of the curb with an air inlet or outlet of the housing. For example, a first duct connector may fluidly couple a return air opening of the curb to an air flow inlet of the housing to enable return air to flow from the structure to the housing. A second duct connector may fluidly couple a supply air opening of the curb to an air flow outlet of the housing to enable supply air to flow from the housing to the structure. The curb assembly further may include additional panels that enclose the space and block fluid flow between an ambient environment and the space. As described herein, the curb assembly may be adjustable to accommodate housings and/or curbs having different dimensions and/or configurations. For instance, each duct connector may be adjustable to enable the duct connector to fluidly couple housings having duct openings in different positions to curbs having openings at different positions. As a result, a single embodiment of the curb assembly may be used to couple different types of HVAC systems to different configurations of curbs. Thus, the curb assembly may decrease manufacturing and assembly costs, as well reduce a complexity associated with installing and coupling a particular HVAC system to a particular curb.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A curb assembly for a heating, ventilation, and/or air conditioning (HVAC) system, comprising: a frame configured to couple to a curb of a structure; a pedestal system configured to couple to a housing of the HVAC system and to the frame, such that the pedestal system extends from the housing to the frame, wherein the pedestal system is configured to enclose a space formed between the frame and the housing; and an adjustable duct connector configured to be disposed within the space, wherein the adjustable duct connector is configured to extend obliquely between the curb and the housing to fluidly couple an air flow passage of the housing with ductwork of the structure, wherein the housing is configured to transition between an extended configuration in which the pedestal system is extended away from a mounting frame of the housing and a compact configuration in which the pedestal system is not extended away from the mounting frame of the housing, wherein the pedestal system is configured to couple to the frame in the extended configuration of the housing, and wherein the pedestal system is coupled to the mounting frame in the extended configuration and in the compact configuration.

2. The curb assembly of claim 1, wherein the pedestal system includes a plurality of support beams and a plurality of panels, wherein the plurality of panels is configured to enclose the space formed between the curb and the housing, and wherein the plurality of support beams is configured to support a weight of the housing.

3. The curb assembly of claim 1, wherein the housing is a rooftop unit housing.

4. The curb assembly of claim 1, wherein the pedestal system is configured to extend along a base surface of the housing in the compact configuration of the housing, and the pedestal system is configured to extend away from the base surface of the housing in the extended configuration of the housing.

5. The curb assembly of claim 1, wherein the adjustable duct connector includes a flange surrounding a perimeter of an end of the adjustable duct connector, wherein the flange is configured to sealingly engage with the air flow passage of the housing.

6. The curb assembly of claim 5, wherein the flange has an L-shaped seat configured to receive a correspondingly shaped mount of the air flow passage.

7. The curb assembly of claim 1, wherein the adjustable duct connector includes a retractable enclosure configured to extend from a first opening of the curb to a second opening of the housing to fluidly couple the first opening and the second opening, wherein the first opening and the second opening are laterally offset from one another relative to an air flow path through the adjustable duct connector.

8. The curb assembly of claim 7, wherein the retractable enclosure includes telescoping panels, a bellows, or both.

* * * * *